US009392898B2

(12) United States Patent
Tsukada

(10) Patent No.: US 9,392,898 B2
(45) Date of Patent: Jul. 19, 2016

(54) FOLDING HANGER

(71) Applicant: CUBE IT LIMITED, Tokyo (JP)

(72) Inventor: Toshihisa Tsukada, Musashino (JP)

(73) Assignee: CUBE IT LIMITED, Tokyo (JP)

( * ) Notice: Subject to any disclaimer, the term of this patent is extended or adjusted under 35 U.S.C. 154(b) by 0 days.

(21) Appl. No.: 14/772,328

(22) PCT Filed: Mar. 7, 2013

(86) PCT No.: PCT/JP2013/056298
§ 371 (c)(1),
(2) Date: Oct. 19, 2015

(87) PCT Pub. No.: WO2013/161400
PCT Pub. Date: Oct. 31, 2013

(65) Prior Publication Data

US 2016/0120350 A1 May 5, 2016

(30) Foreign Application Priority Data

Apr. 27, 2012 (JP) ..... 2012-103711

(51) Int. Cl.
*A47G 25/40* (2006.01)
*A47G 25/32* (2006.01)

(52) U.S. Cl.
CPC ..... *A47G 25/4015* (2013.01); *A47G 25/32* (2013.01); *A47G 25/40* (2013.01); *A47G 25/403* (2013.01); *A47G 25/4023* (2013.01)

(58) Field of Classification Search
CPC ... A47G 25/32; A47G 25/40; A47G 25/4015; A47G 25/4023; A47G 25/403; A47G 25/4038; A47G 25/4061; A47F 7/19; A41D 27/22
USPC ..... D6/315, 324
See application file for complete search history.

(56) References Cited

U.S. PATENT DOCUMENTS 847,211 A * 3/1907 Stein ..... A47G 25/4023 223/94
1,336,375 A * 4/1920 Owen ..... A47G 25/403 223/90
1,370,713 A * 3/1921 Strand ..... A47G 25/4023 223/89
1,448,139 A * 3/1923 McGinnis ..... A47G 25/4023 223/89

(Continued)

FOREIGN PATENT DOCUMENTS

JP H07-039661 U 7/1995
JP 2002-051899 A 2/2002
JP 3112650 U 8/2005

OTHER PUBLICATIONS

International Search Report corresponding to Application No. PCT/JP2013/056298; Date of Mailing: Apr. 16, 2013, Issued in English.

(Continued)

*Primary Examiner* — Ismael Izaguirre
(74) *Attorney, Agent, or Firm* — Baba Patent Agency

(57) ABSTRACT

A folding hanger includes of a pair of arms and a hook. Above-mentioned pair of arms and the hook have a common axis of rotation and each arm of the arms is structured by two parallel boards and an intermediate board connecting the two parallel boards. An angle between the center line of the arm and an edge line, which passes through the common axis of rotation and an edge of the intermediate board, is set between 50 degrees and 80 degrees.

4 Claims, 15 Drawing Sheets

(56) References Cited

U.S. PATENT DOCUMENTS

| | | | | | |
|---|---|---|---|---|---|
| 1,673,059 | A | * | 6/1928 | Baier | A47G 25/403 223/89 |
| 2,470,079 | A | * | 5/1949 | Kelsey | A47G 25/403 223/95 |
| 2,633,276 | A | * | 3/1953 | Gillespie | A47G 25/403 223/90 |
| 2,872,090 | A | * | 2/1959 | Goodman | A47G 25/4023 223/94 |

OTHER PUBLICATIONS

Translation of International Search Report Written Opinion, Date of Mailing: Apr. 16, 2013.

Translation of International Preliminary Examination Report corresponding to No. PCT/JP2013/056298; Date of Mailing: Feb. 10, 2015.

* cited by examiner

FOLDING HANGER

TECHNICAL FIELD

This invention relates to cloths hanger.

BACKGROUND ART

Hangers are used to hang cloths. They are the necessities indispensable to the everyday life. However, their forms are big and long, and moreover they have a complex shape. Being bulky, they occupy space of drawers even when they are not used. They are not suitable to bring with you when going out. It will be comfortable if you can carry them in the bags or trunks. But you cannot carry them because of the size and the shape of them.

CITATION LIST

Patent Literature

[Patent Reference 1] Japanese Published Unexamined Patent Application No. 2002-51899.

[Patent Reference 2] Japanese Published Unexamined Patent Application No. 2003-169743.

[Patent Reference 3] Japanese Published Unexamined Patent Application No. 2004-261416.

[Patent Reference 4] Japanese Published Unexamined Patent Application No. 2005-348993.

[Patent Reference 5] Japanese Published Unexamined Patent Application No. 2008-264477.

[Patent Reference 6] Japanese Published Unexamined Patent Application No. 2011-235042.

SUMMARY OF INVENTION

Technical Problem

The conventional hangers cannot be handled easily because they are large and long and their shapes have complex structure. Such hangers have been looked for which can be folded to be put into the bag and can be unfolded to hang cloths when you go to the restaurant, etc. When leaving the restaurant you can fold it and can be carried in the bag.

This invention describes the hangers to be folded. Their structure is simple and is without necessity of such special parts like spring or clasp. Yet, they can be folded and unfolded easily. Folded hangers are compact and suitable to carry in the bag.

In this invention, the hook is folded as well as the arms in a folded state. When the arms are spread, the hook also spreads out of the arms. In order to ensure this behavior, the structure of the hanger and the arm is so designed to solve this issue. In addition, another issue for a hook to be pulled out when the hanger is folded, is also solved.

Solution to Problem

One form of this folding hanger to achieve the above mentioned objective is that of a hanger composed of a pair of arms and a hook, and these arms and a hook are characterized to have a common axis of rotation.

Advantageous Effects of Invention

Hanger is made possible to be folded. A hanger is made possible to change its state from folded to unfolded alternately, without any special parts like clasp or spring, etc. Yet stable operation is made possible when used. In a folded state, it becomes very compact and can be carried in a bag or so. If hung on the wall using a hole, it doesn't look like a hanger and can enjoy a good appearance.

DESCRIPTION OF EMBODIMENTS

Hangers are made of a pair of arms and a hook which have a common axis of rotation. Each arm has two parallel plates and an intermediate plate to connect them. Material of arms and a hook is plastic, wood, metal, etc.

Each arm rotates to the opposite direction to the other, by more than 100 degrees, and stops there. The angle between the edge line and the center line of the arm is set to be between 50 degrees and 80 degrees.

The end of the arm is designed to be within the edge circle region, in order for the arm to be rotated sufficiently and not interrupted inadequately.

At the end of the hanger, a protrusion (hook stopper) is formed so as for the hook not to be hidden in the arm when the arm is unfolded.

A pair of arms and a hook is made of metal wires and the edge is formed by deforming the wire.

EXAMPLE 1

Figure 1:
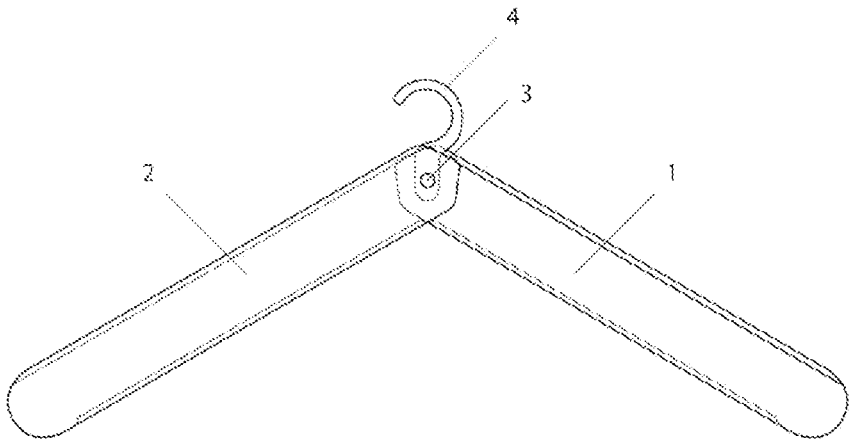
FIG. 1 This shows an example of this invention's implementation.
Figure 2:
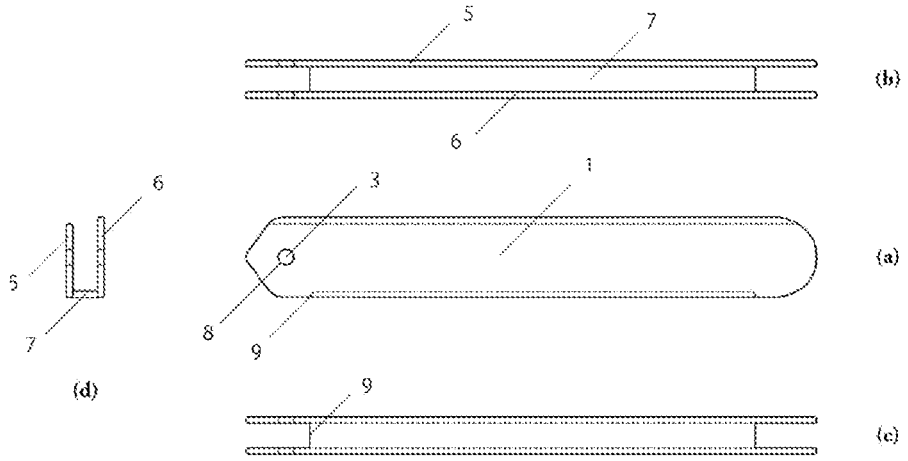
FIG. 2 This figure shows the side elevation (a), top plan view (b), bottom plan view (c), and front elevation (d), respectively, of the arm of the implementation shown in FIG. 1.
Figure 3:
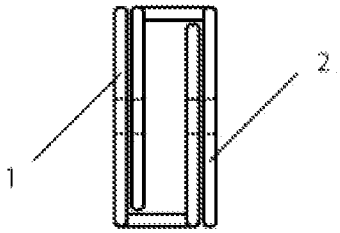
FIG. 3 This figure shows a formation of two arms, arm I 1 and arm II 2, of the implementation shown in FIG. 1, viewed from the front side of the folded hanger.

FIG. 1 to FIG. 9 show an implementation of this invention and show the detail of this invention by way of the transparent drawings of the arm and the hook of the hanger. A pair of arms and a hook has a common axis of rotation. The edge of the intermediate board hits the parallel plate of the other arm and stops there, and the hanger keeps its stable position. As shown in FIG. 3, a pair of arms is formed face-to-face to each other. In this Figure, hook has been omitted.

This invention makes it possible for the hanger to be folded. For this, hanger is made of a pair of arms and a hook. FIG. 1 shows an example of the implementation, and shows the transparent view of the hanger to make it easier to see the internal structure. The hanger has a pair of arms, the first arm 1 and the second arm 2. The arm I and the arm II have a common axis of rotation 3. Sign 4 corresponds to the hook.

FIG. 2 shows the shape of the arm of this foldable hanger shown in FIG. 1. This shows the side view (a), the top view (b), the bottom view (c), and the front view (d) of the arm. As shown in FIG. 2(d), the arm is made of a parallel board 5, a parallel board 6 and an intermediate board 7 connecting two parallel boards. The circular hole 8 is formed in the arm and a common axis of rotation 3 runs through this hole. Two parallel plates 5 and 6 are not necessarily to be perfectly parallel, but they can be spread outward.

The intermediate board 7 shown in FIG. 2(*a*) to (*d*), is drawn to be just planar, but it's not necessary to be exactly so. That is, the cross section of FIG. 2(*d*) could be U shape, for example. The sign 9 shown in FIG. 2(*a*) to (*c*) is the edge of the intermediate board 7. More specifically, the edge 9 is the one nearest to the common axis of rotation. Moreover, the shape of the intermediate board can have many styles. They may be deformed and can be multiple. The edge 9 here corresponds to the edge of the above mentioned intermediate board, nearest to the common axis of rotation 3.

Two arms, arm I and arm II, have basically the same shape, and they face to each other to form a hanger. This formation of arms is seen in FIG. 3. In this figure, a hook has been omitted. As shown in FIG. 3, the width of two parallel boards is different. This is because the arms can be folded perfectly.

Figure 4:
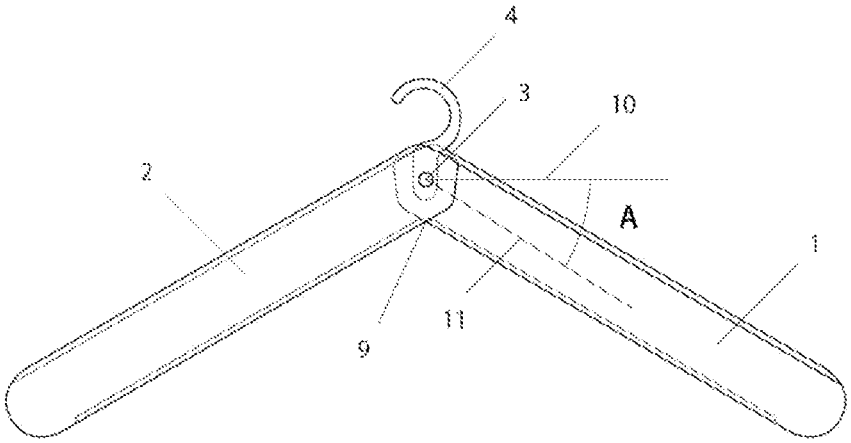
FIG. 4 This figure shows the edge 9 which has been omitted in FIG. 1 and it also shows the angle A between the horizontal line 10 and the center line of the arm 11, when the hanger is on a working state.

FIG. 4 is a reproduction of FIG. 1, and the edge 9 is shown here which has not been cited in FIG. 1. FIG. 4 shows that the edge of one arm hits the parallel board of the other arm and stops there. This is the status of the hanger to function.

The angle A shown in FIG. 4 is defined as the one between the horizontal line 10 running through the common axis of rotation, and the center line 11 of the arm. Typical value of this angle is 30 degrees, but this is not necessarily a fixed value. However, if this angle exceeds 40 degrees, cloths may slide down.

Figure 5:
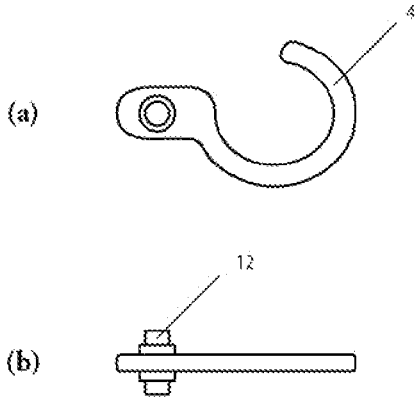
FIG. 5 This shows an example of the hook of this invention, and this example shows the supporting rod 12 and the hook 4 incorporated together and the core of the rod shares the common axis of rotation 3 with the center of the circular hole 8.

In FIGS. 1 and 4, the arm supporting rod is necessary, which runs through the common axis of rotation 3. FIG. 5 shows the supporting rod 12 has been incorporated into the hook 4. The side view of the hook is shown in FIG. 5(*a*) and the bottom view is shown in FIG. 5(*b*). Two-stage configuration of the rod is shown here. The core of the rod shares the common axis of rotation 3. The supporting rod 12 and the hook 4 can be made separately, apart from the example shown here.

Figure 6:
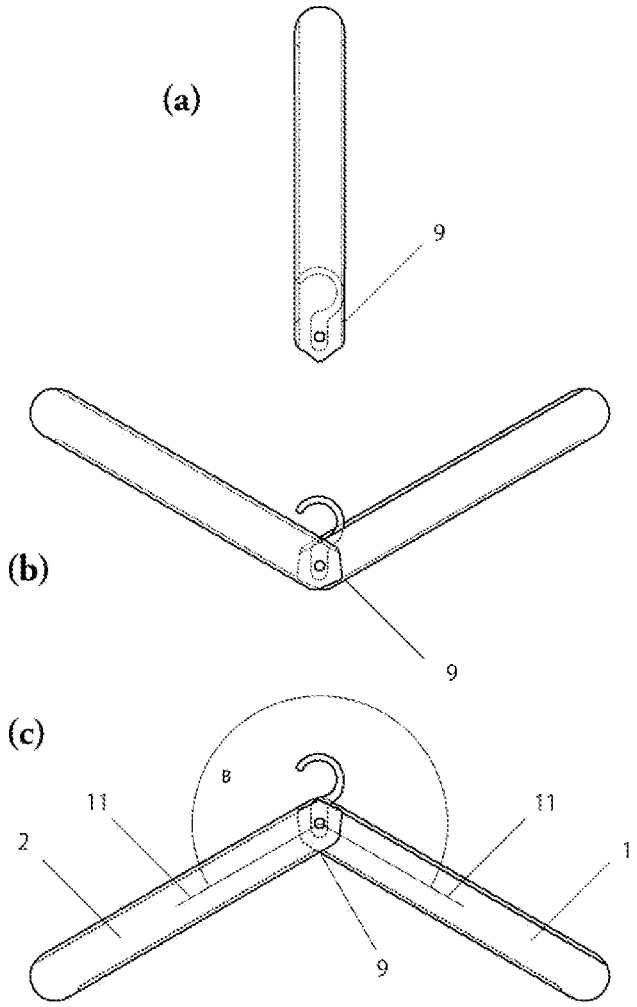
FIG. 6 This shows the shape change of the hanger shown in FIG. 1 where (a) shows a folded state, (b) an intermediate state, and (c) an unfolded position. The angle B is the angle between the arm I 1 and the arm II 2 when the hanger is on an operating position.

FIG. 6 shows the shape variation of the hanger shown in FIG. 1. FIG. 6(*a*) shows a folded state, FIG. 6(*c*) a working state, and FIG. 6(*b*) an intermediate state. When the arms are rotated outward, the edge 9 also rotates. Then, the edge hits the parallel plate of the other arm and stops there.

In this state of FIG. 6(*c*), the angle B is defined as the one between two arms. The angle B becomes 240 degrees when the angle A is 30 degrees.

When cloths are taken out of the hanger, the hanger can recover a linear shape and it can be stored in the bag entirely. Hook is also folded and disappears as shown in FIG. 6(*a*).

Figure 7:
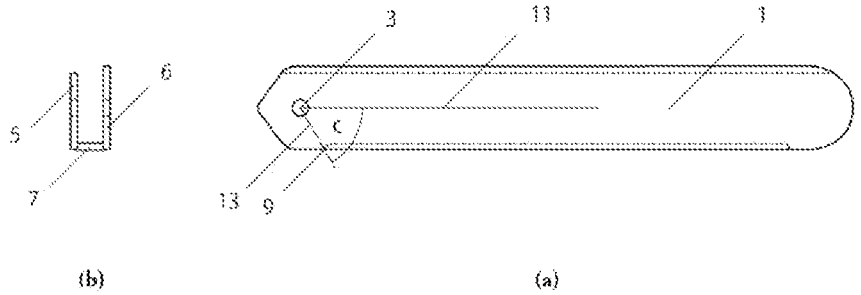
FIG. 7 This shows the edge angle C in the implementation shown in FIG. 1, which is defined as the one between the center line of the arm 11 and the edge line 13, and shows a side view (a) and a front view (b) of the arm.

FIG. 7 shows the condition for the hanger to function properly. In FIG. 4, the angle A was defined as the angle between the arm center line and the horizontal line. Generally speaking, the angle A is around 30 degrees. The angle C in FIG. 7 is the one between the center line of the arm 11 and the line 13. The line 13 is the one connecting the common axis of rotation 3 and the edge 9. If this line is called an edge line, the edge line 13 becomes vertical when the hanger is on.

If you look at FIG. 4 and FIG. 7, it is seen that the addition of angle A and angle C is equal to 90 degrees. As was described, the hanger is difficult to function if the angle A is larger than 40 degrees. This means that angle C will be imposed to be larger than 50 degrees. On the other hand, if this angle C becomes 90 degrees, the arms of the hanger will be horizontal. Therefore, angle C should be larger than 50 degrees and should be less than 90 degrees. This angle C will be called an edge angle from now on.

More practical value of angle A will be between 40 degrees and 10 degrees. So that, angle C should be between 50 degrees and 80 degrees.

Then, the rotation angle of each arm will be between 100 degrees and 130 degrees. This is the angle of the arm spread from folded to unfolded state. The angle B in FIG. 6 becomes larger than 200 degrees and less than 260 degrees.

Figure 8:
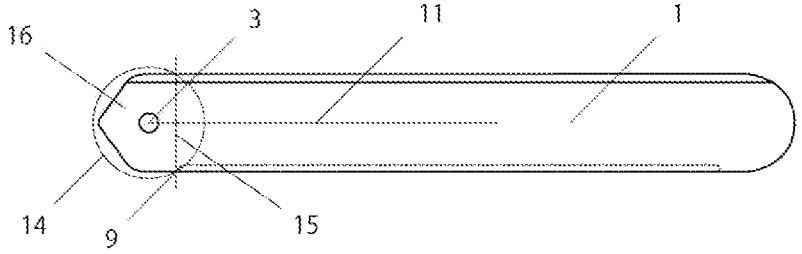
FIG. 8 This shows the limitation for the arm shape, and the end of the arm is within the edge circle region 16.

FIG. 8 shows one more necessary condition in this invention. The edge circle 14 in this figure is the one of which the center is common with the axis of rotation 3, and the radius is equal to the distance from the common axis 3 to the edge 9. Then the edge circle region 16 is defined as the region surrounded by the solid part of the circle 14 and the line 15. The line 15 is referred to the one through the edge 9 and perpendicular to the arm center line 11.

If you look at FIG. 8, it can be seen that top part of the arm, that includes the common axis, is within the edge circle region 16. This is the necessary condition that the hanger works properly. Because, the arm rotation will be blocked on the way to the on state, if this top part of the arm is outside of the region 16.

Figure 9:
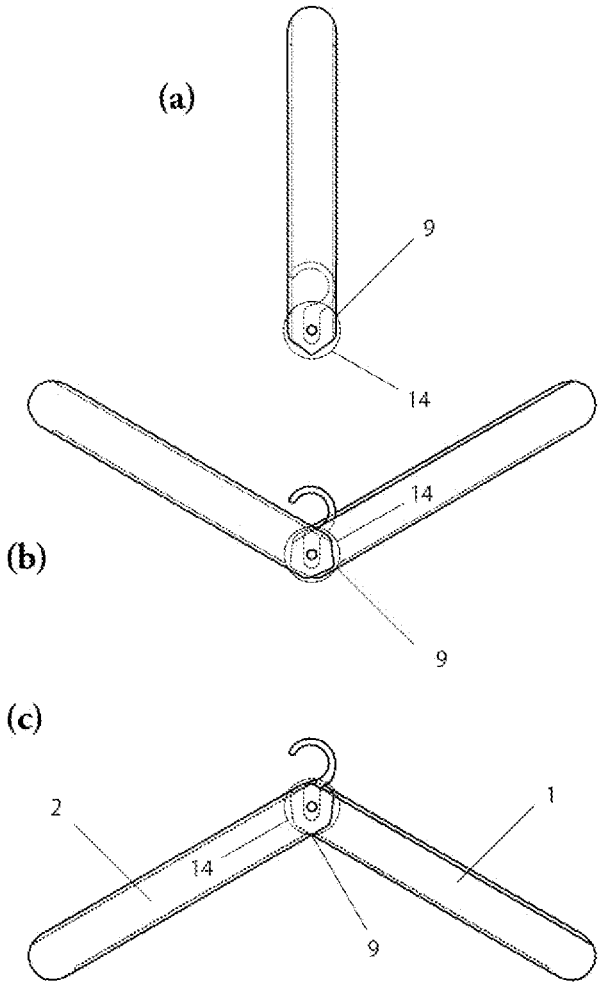
FIG. 9 The condition of FIG. 8 is shown here with the edge circle 14 in an example of FIG. 1, and this figure shows that the hanger can be opened smoothly under this condition.

FIG. 9 shows the rotation of the arm of FIG. 8 along with the edge circle 14. The rotation of the arm will not be blocked at the intermediate state shown in FIG. 9(*b*). In FIG. 9(*c*), the edge hits the other arm and settles down in proper place.

EXAMPLE 2

Figure 10:
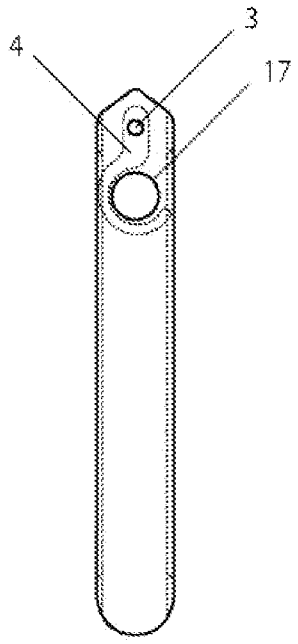
FIG. 10 This shows another example of this invention, where the hole 17 is made on a pair of arms.

FIG. 10 shows an example in which each arm has a hole 17. This hole will make it possible for a hanger to be hung on the wall when the hook is folded into the arm.

EXAMPLE 3

Figure 11:
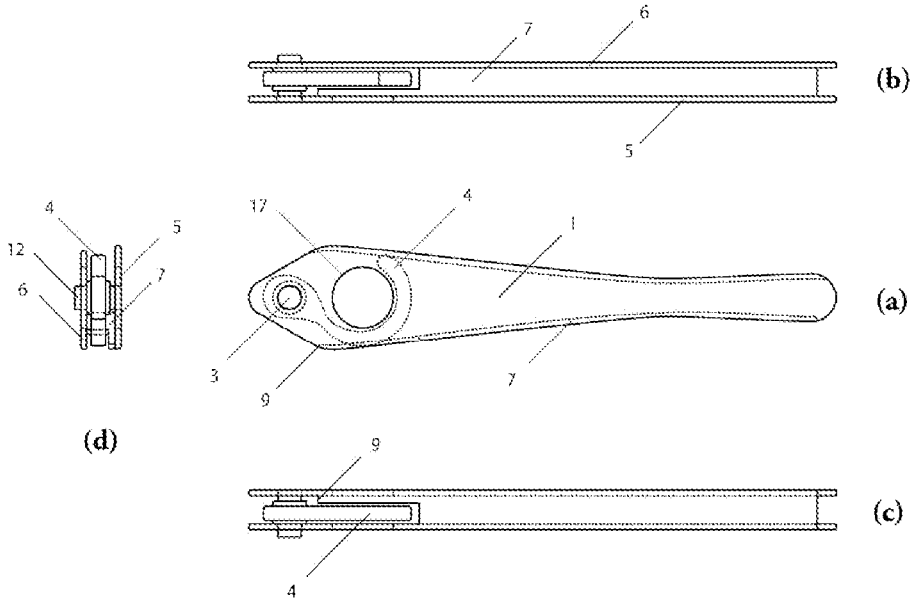
FIG. 11 This shows another implementation of this invention, where the shape of the arm is modified from that of FIG. 1, and shows the side view (a), the top view (b), the bottom view (c), and the front view (d), respectively.

In an example shown in FIG. 10, the hanger was hung by way of the hole 17. It will be more convenient for a hanger to be hung by way of a hook even when the hanger is in closed situation. FIG. 11 shows this situation.

FIG. 11 shows another implementation of this invention. The shape of arm is modified from that of FIG. 1, as shown in FIG. 11(*a*) side view, (*b*) top view, (*c*) bottom view, and (*d*) front view.

The point of the implementation shown in FIG. 11 is that the shape of the intermediate board 7 is modified. There is a defective part in the intermediate board without changing the position of the edge 9. By this way, a hook can be taken out freely. Hanger can be hung either by a hole 17 or by a hook 4.

EXAMPLE 4

Figure 12:
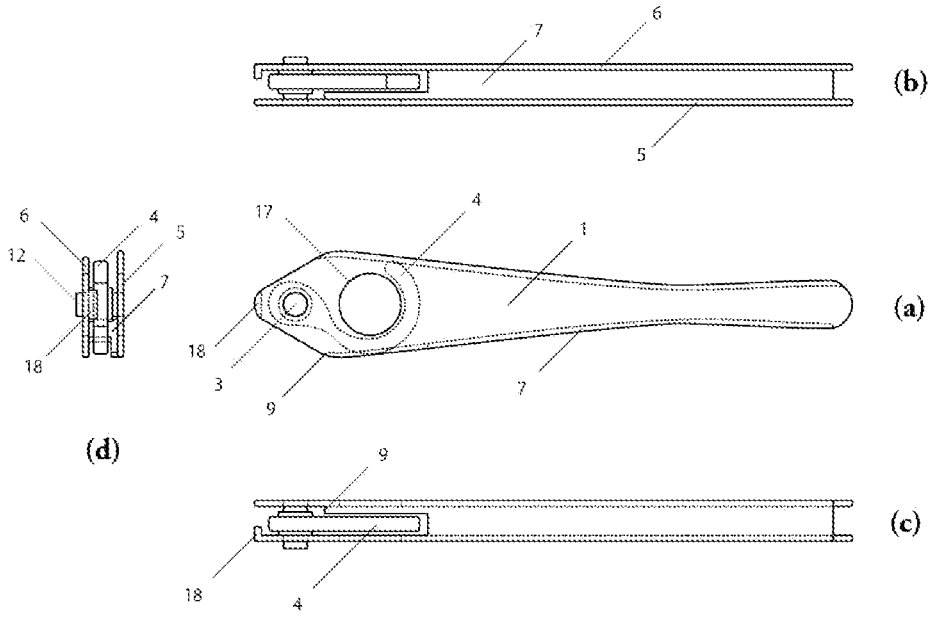
FIG. 12 This show another example of this invention, where the hook stopper 18 is formed at the end of the arm.

FIG. 12 shows another implementation of this invention providing one more function. This figure is basically the same as FIG. 11, however, hook stopper 18 has been added to the arm. The function of this stopper is to limit too free rotation of the hook, as shown in FIGS. 13 and 14.

It is usually expected that the hook gets out of the arm when the hanger is on state. However, hook may occasionally be hidden in the arm. In this case an extra operation is necessary to take the hook out. The role of a hook stopper 18 is to avoid this situation.

Figure 13:
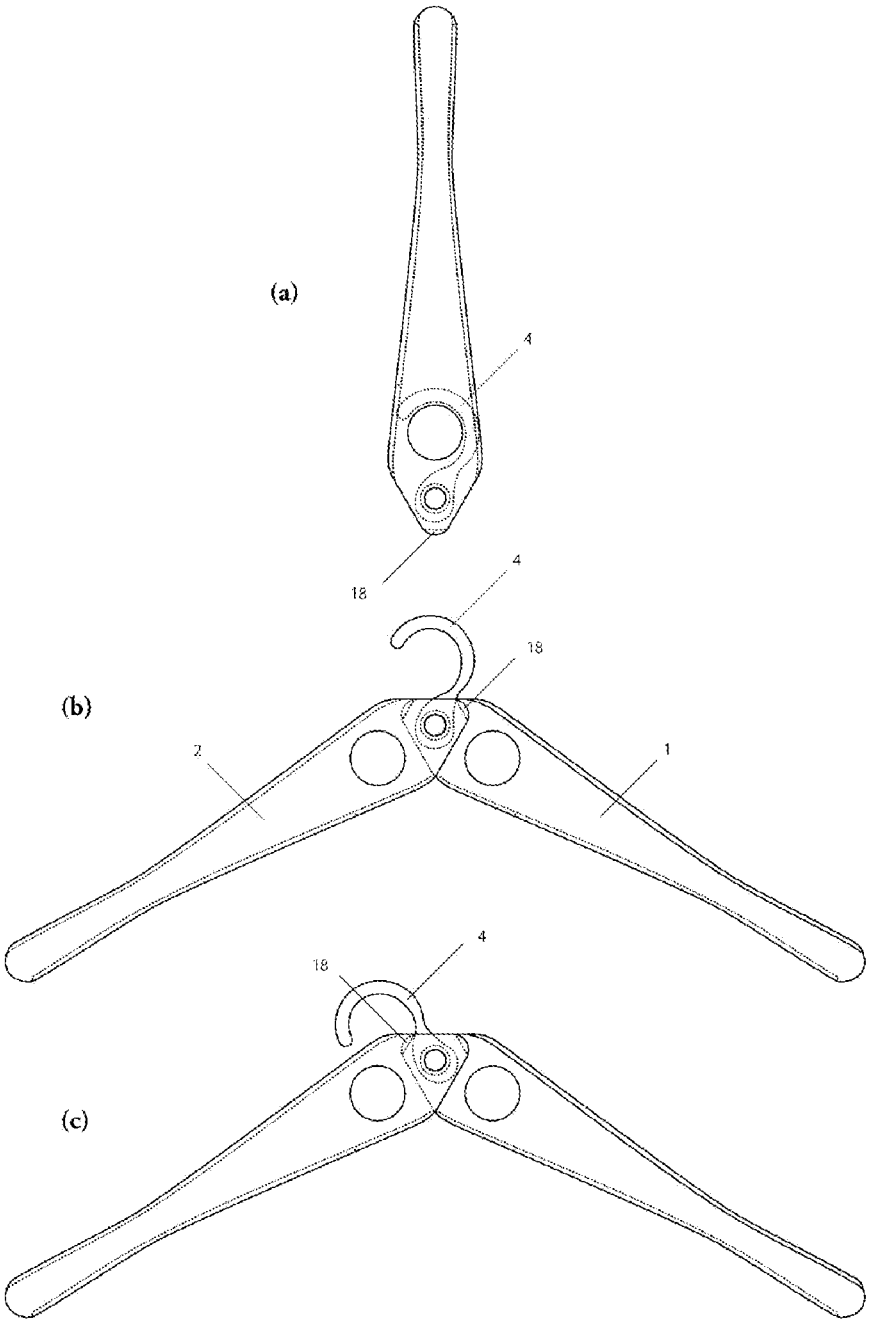
FIG. 13 This shows the hanger shown in FIG. 12, where the hanger is opened from the closed position (a), to the operating position (b) or (c).
Figure 14:
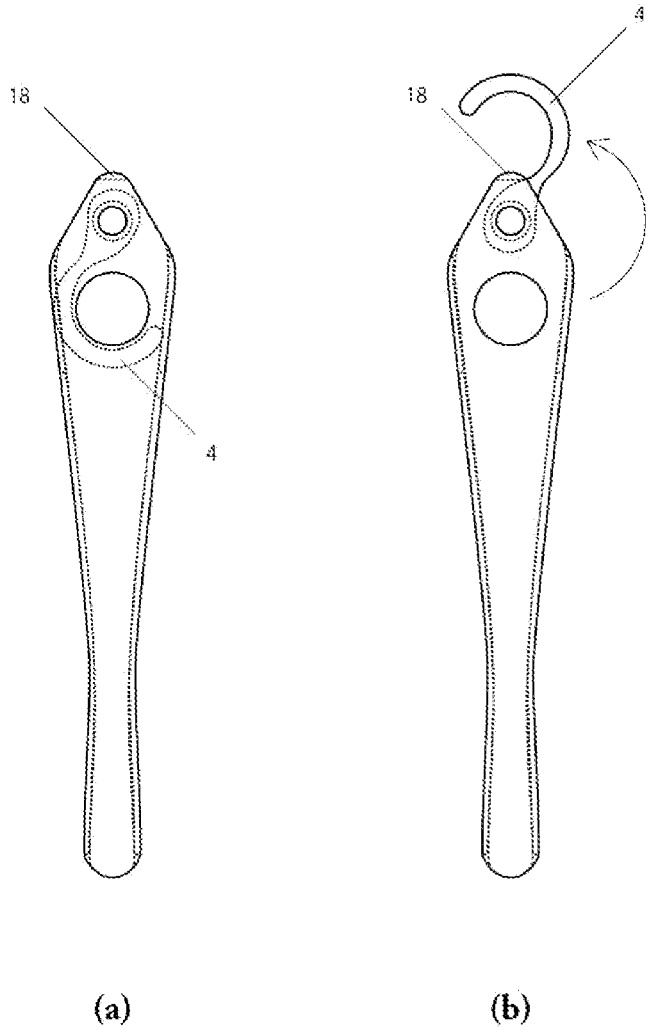
FIG. 14 This shows a hook 4 can be taken out of the arm in the closed hanger situation.

FIG. 13 shows this improvement. When the hanger is opened to FIG. 13(*b*) or FIG. 13(*c*), from FIG. 13(*a*), hook stays outside of the arm interrupted by the hook stopper 18.

On the other hand, hook is expected to be taken out even in the closed hanger situation. The shape of the hook has been so designed for this to take place. As shown in FIG. 14, hook is rotated to the direction shown by the arrow in FIG. 14(*b*) to be taken out.

EXAMPLE 5

Figure 15:
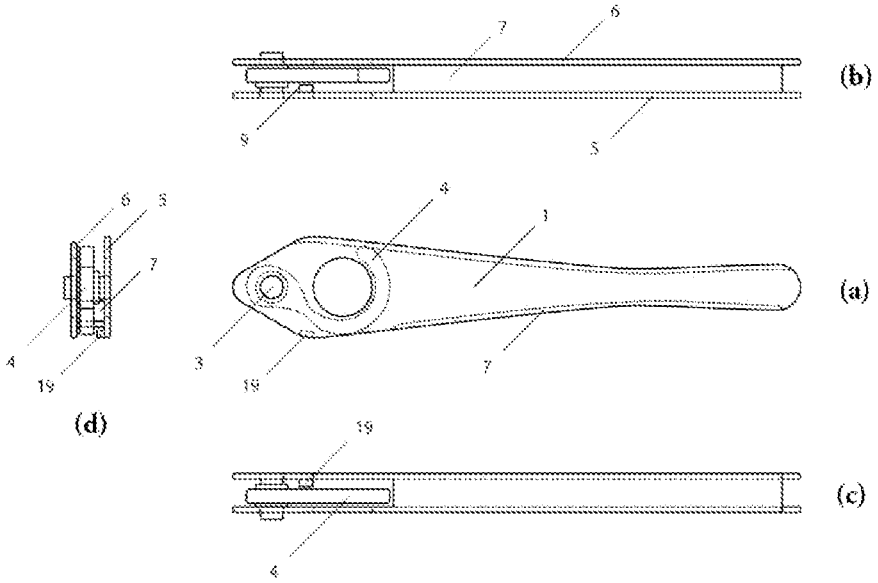
FIG. 15 This shows another example of this invention, where the shape of the arm is modified with a protrusion 19 formed between parallel boards.

FIG. 15 shows another implementation of this invention, apart from the examples shown above. The basic configuration is the same as in FIG. 1, but the protrusion 19 is formed independently from the intermediate board 7, which stops the rotation of the other arm. The end of the protrusion is the edge 9.

EXAMPLE 6

Figure 16:
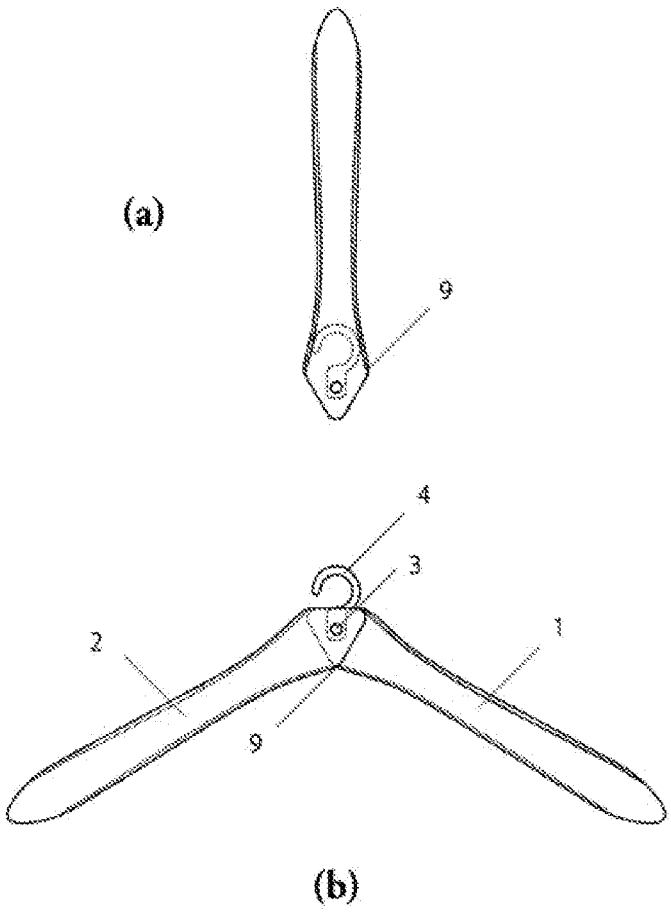
FIG. 16 This shows another example of this invention, where the shape of the arm is different from those examples described above, and shows a folded position (a) and an unfolded position (b) of the hanger.

FIG. 16 is another example of this invention in perspective way. The arm shape is different from that of those examples shown above.

In folding hangers described above, it is possible for a hanger to be folded without any special clasp or spring, etc. It is possible for a hanger to change its state from a closed to an operating position alternately. Yet stable operation is possible at the on state and in closed state of the hanger. It becomes very compact in a folded state, suitable for carrying. If it is hung on the wall using a hole 17, it enjoys a good appearance and it doesn't look like a hanger.

In examples as shown in FIG. 1, etc. hanger functions properly as an edge hits the arm. This is a very simple scheme and it works well in spite of its simplicity. In an example shown in FIG. 17, a part of wire 23 hits the wire arm and it works. This is also a very simple scheme.

In this invention, each arm rotates 90 degrees and more. This makes this invention to realize much more flexibility and stability compared with those former ideas using a rotation angle less than 90 degrees In this invention, there is a certain restriction on the form of the arms. The end of the arm is so designed to be within the edge circle region of the arm. This makes it possible for a hanger to keep its proper working position.

Number of parts to make a hanger in this invention is only three and type of parts is just two. As a result, parts assembly and removal is extremely easy. Productivity and workability can be enhanced quite a bit.

This invention makes it possible for a hook not to be hidden within the arm when the hanger is on state. This is made possible by way of a very simple structure of arm and hook. Process to take out the hidden hook can be eliminated.

Moreover, it is possible to extract the hook out even when the hanger is folded. A hanger can be hung to walls either by way of a hook or by way of a hole of the arm.

EXAMPLE 7

Other examples of this invention are shown from FIG. 17 to FIG. 20. Examples in which arms and a hook are made of metal wires.

Figure 17:
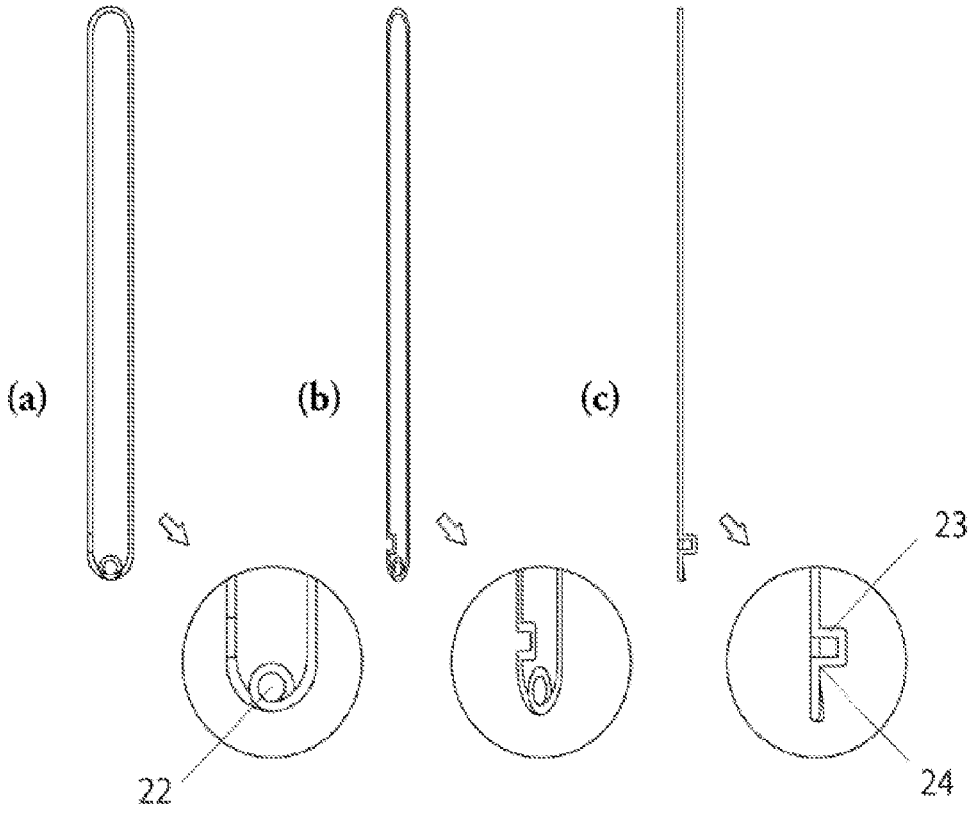
FIG. 17 This shows another example of this invention that makes use of the metal wire to form an arm.

In the examples above, such materials like plastic or wood, etc. have been assumed to make a hanger. On the other hand, the material can be metal. There are many hangers made of wire. Here in this invention also, folding hanger made of wire can be realized and the same function as described above can be expected. FIG. 17 shows an example of this kind of hanger (arm).

FIG. 17 shows this arm's front view (a), 45-degree tilt view (b), and 90-degree tilt view (c). In the circles, the expanded views of these arms are shown. As with the above examples, there is a common axis of rotation 22 in the arm as shown in this figure. There is a protrusion 23 in this arm perpendicular to the arm plane. This is just an example and there could be many variations of this part. And also this part must not be perpendicular to the arm plane.

Figure 18:
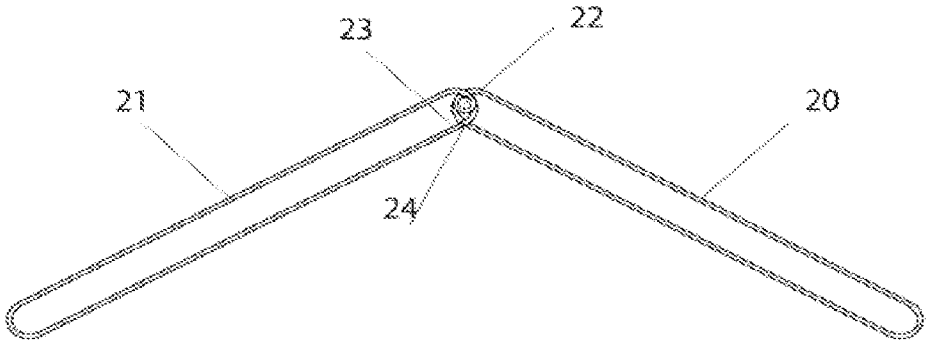
FIG. 18 This shows the operating position of the hanger arms shown in FIG. 17.

A pair of wire arm 20 and 21 faced to each other will be rotated around the axis of rotation 22. At the point where the edge 24 of the part 23 hits the other arm, hanger takes its working position as shown in FIG. 18. This form of wire arm shape is just an example, and there will be many other variations.

Figure 19:
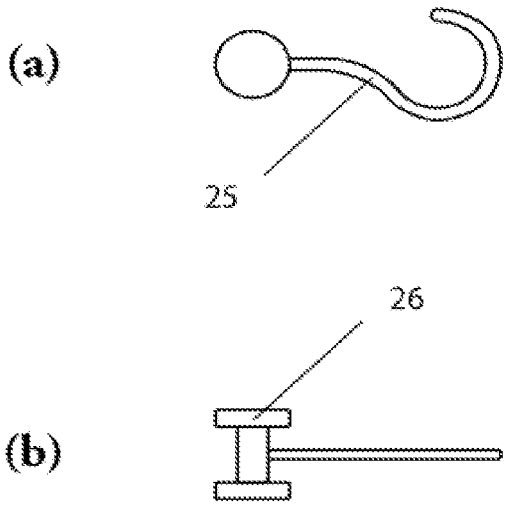
FIG. 19 This shows an example of the wire hook 25 and the support rod 26 combined together for the example shown in FIG. 17.

FIG. 19 shows a hook 25 and a support rod 26 which have been omitted in FIG. 18. This example shows a wire hook embedded in the support rod made of plastic. This support rod can also be made of wire, of course.

Figure 20:
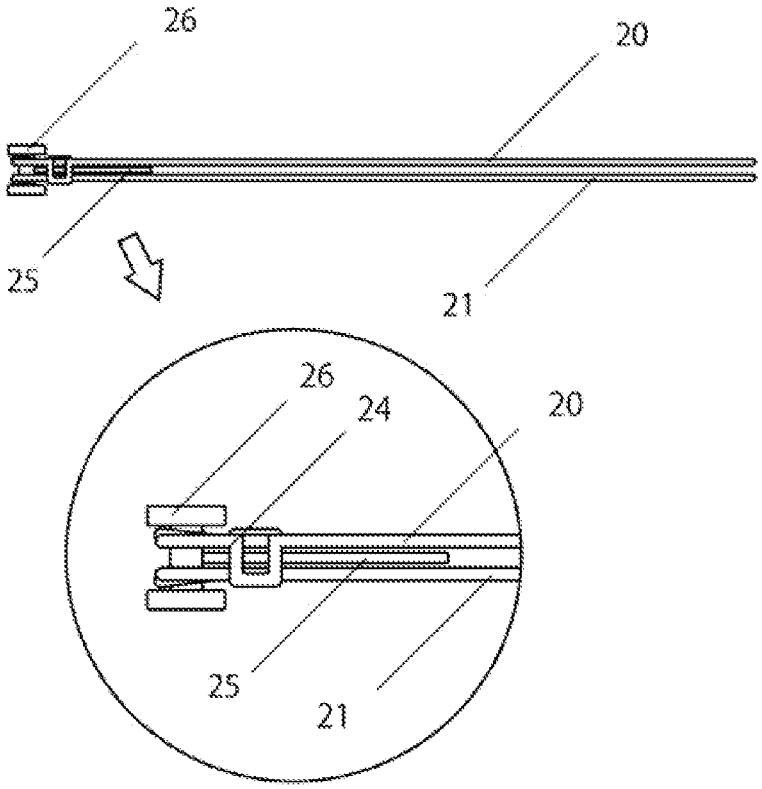
FIG. 20 This shows the hanger made with the wire arms.

FIG. 20 shows a combination of a pair of wire arms 20 and 21, hook 25, and a support rod 26. The expanded view of the hanger end is shown in the circle. In addition, the wire hook shown here and a pair of arms implementation described above (FIG. 1, etc.), can be a good combination. One example is that the wire hook is used in the combination of a hook and a support rod shown in FIG. 5, and this is a highly practical configuration.

In hangers made of metal as described, they will be lighter in weight, if arms and a hook are made of wire. Material is low in cost and the formation of the edge can be simplified.

INDUSTRIAL APPLICABILITY

Hangers presented here in this invention, can change the conventional concept, and open a new possibility of the hanger world.

What is claimed is:

1. A folding hanger comprising:

a pair of arms: and a hook, wherein the above-mentioned pair of arms and the hook have a common axis of rotation, wherein each arm of the arms is structured by two parallel boards and an intermediate board connecting the two parallel boards, wherein one of the two parallel boards of one of the pair of arms is folded into a space formed by the two parallel boards and the intermediate board of the other of the pair of arms so that shape of the folding hanger viewed from a common axis direction is the same as shape of the one of the pair of arms when the folding hanger is in a folded state, and wherein an angle between a center line of the arm and an edge line, which passes through the common axis of rotation and an edge of the intermediate board, is between 50 degrees and 80 degrees.

2. The folding hanger as mentioned above in the claim 1, wherein the two parallel boards of each arm have different widths.

3. The folding hanger as mentioned above in the claim 1, wherein a top of the arm nearer to the common axis of rotation, is located within an edge circle region, which is surrounded by an edge circle, a center of the edge circle being located on the common axis of rotation, a radius of the edge circle being equal to the distance between the edge of the intermediate board and the common axis of rotation of the arm, and a line which passes through the edge, the line being perpendicular to the center line of the arm.

4. The folding hanger as mentioned above in the claim 1, wherein a hook stopper forms a part of the arm.

* * * * *